US010107566B2

(12) United States Patent
Förster et al.

(10) Patent No.: US 10,107,566 B2
(45) Date of Patent: Oct. 23, 2018

(54) CONDENSER

(75) Inventors: Uwe Förster, Erdmannhausen (DE); Herbert Hofmann, Stuttgart (DE); Christoph Walter, Stuttgart (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 478 days.

(21) Appl. No.: 14/112,998

(22) PCT Filed: Apr. 19, 2012

(86) PCT No.: PCT/EP2012/057174

§ 371 (c)(1),
(2), (4) Date: Oct. 21, 2013

(87) PCT Pub. No.: WO2012/143451

PCT Pub. Date: Oct. 26, 2012

(65) Prior Publication Data

US 2014/0054016 A1 Feb. 27, 2014

(30) Foreign Application Priority Data

Apr. 20, 2011 (DE) ..... 10 2011 007 784

(51) Int. Cl.
*F28F 1/00* (2006.01)
*F28D 7/00* (2006.01)
(Continued)

(52) U.S. Cl.
CPC ..... *F28F 1/00* (2013.01); *F25B 39/04* (2013.01); *F28D 7/0025* (2013.01); *F28F 1/022* (2013.01);
(Continued)

(58) Field of Classification Search
CPC . F28F 1/00; F28F 1/022; F28D 7/0025; F25B 39/04
(Continued)

(56) References Cited

U.S. PATENT DOCUMENTS 4,825,941 A * 5/1989 Hoshino ..... B21C 37/22 165/110
4,998,580 A * 3/1991 Guntly ..... F25B 39/02 165/133
(Continued)

FOREIGN PATENT DOCUMENTS

EP 1 065 454 A1 1/2001
EP 1 068 967 A1 1/2001
(Continued)

OTHER PUBLICATIONS

International Search Report, PCT/EP2012/057174, dated Jul. 30, 2012, 2 pgs.
(Continued)

*Primary Examiner* — Raheena R Malik
(74) *Attorney, Agent, or Firm* — Paul D. Strain, Esq.; Strain & Strain PLLC

(57) ABSTRACT

The invention relates to a condenser, in particular a condenser cooled by a coolant, said condenser consisting of at least one tube/fin block having several flat tubes, each flat tube having a plurality of flow channels that extend adjacent to one another in the tube transverse direction and define a refrigerant-side hydraulic diameter ($D_{h\ refrigerant}$). At least one respective intermediate element defining a coolant-side hydraulic diameter ($D_{h\ coolant}$) is arranged in the region of the flat tubes. The condenser is characterized in that the ratio of the two hydraulic diameters ($D_{h\ coolant}$) to ($D_{h\ refrigerant}$) is greater than (>) 1.3.

13 Claims, 4 Drawing Sheets

(51) Int. Cl.

| | |
|---|---|
| ***F25B 39/04*** | (2006.01) |
| ***F28F 1/02*** | (2006.01) |
| ***F28F 1/04*** | (2006.01) |
| *F28D 1/053* | (2006.01) |
| *F28D 21/00* | (2006.01) |

(52) U.S. Cl.
CPC ..... *F28F 1/04* (2013.01); *F25B 2500/01* (2013.01); *F28D 1/05375* (2013.01); *F28D 2021/007* (2013.01)

(58) Field of Classification Search
USPC ..... 165/146, 110, 176, 166
See application file for complete search history.

(56) References Cited

U.S. PATENT DOCUMENTS 5,080,167 A 1/1992 Wolf
5,190,100 A * 3/1993 Hoshino ..... B21C 37/22 165/110
5,203,407 A * 4/1993 Nagasaka ..... F28D 1/05375 165/174
5,743,328 A * 4/1998 Sasaki ..... F28D 1/0417 165/144
5,988,267 A * 11/1999 Park ..... F25B 39/04 165/110
6,125,922 A 10/2000 Yamamoto et al.
6,170,565 B1 * 1/2001 Nishishita ..... F28D 1/0435 165/135
6,209,628 B1 * 4/2001 Sugimoto ..... F28D 1/0435 165/135
6,216,776 B1 * 4/2001 Kobayashi ..... F28D 1/05383 165/110
6,508,073 B2 * 1/2003 Noro ..... F24H 4/04 62/238.6
6,561,264 B2 * 5/2003 Ozaki ..... F28D 1/0435 165/135
6,889,757 B2 * 5/2005 Iwasaki ..... F28D 1/0435 165/135
6,904,963 B2 * 6/2005 Hu ..... F28D 1/0443 165/140
6,935,414 B2 * 8/2005 Kawakubo ..... F25B 40/00 165/110
6,938,684 B2 * 9/2005 Iwasaki ..... F28D 1/0408 165/135
6,957,694 B2 * 10/2005 Iwasaki ..... F28D 1/0435 165/140
6,986,385 B1 * 1/2006 Gilles ..... B60H 1/00328 165/140
7,293,604 B2 * 11/2007 Sasaki ..... F28D 7/0025 165/164
7,337,832 B2 * 3/2008 Hu ..... F28D 1/0443 165/140
2003/0066636 A1 * 4/2003 Kawakubo ..... F25B 40/00 165/164
2003/0209344 A1 * 11/2003 Fang ..... F28D 1/0443 165/140
2005/0051317 A1 * 3/2005 Chin ..... F28D 1/05391 165/177
2006/0151160 A1 * 7/2006 Take ..... F25B 39/00 165/177
2009/0178435 A1 * 7/2009 Hiyama ..... F25B 39/04 62/509
2011/0071307 A1 * 3/2011 Ishiyama ..... C07C 269/02 549/513
2011/0186277 A1 * 8/2011 Hanafusa ..... F25B 39/04 165/173
2011/0213305 A1 * 9/2011 Jonsson ..... A61M 1/3621 604/113
2012/0031586 A1 * 2/2012 Sugimura ..... F25B 39/04 165/104.21
2012/0234523 A1 * 9/2012 Jouanny ..... F28D 9/005 165/166
2014/0202194 A1 * 7/2014 Matsumoto ..... F25B 40/02 62/324.6

FOREIGN PATENT DOCUMENTS

GB 2 346 680 A 8/2000
WO WO 01/88454 A1 11/2001
WO WO 2004/042293 A1 5/2004
WO WO 2009/013179 A2 1/2009

OTHER PUBLICATIONS

German Search Report, DE 10 2011 007 784.7, dated Aug. 23, 2011, 8 pgs.

* cited by examiner

CONDENSER

CROSS-REFERENCE TO RELATED PATENT APPLICATIONS

This application is a National Stage of International Application No. PCT/EP2012/057174, filed Apr. 19, 2012, which is based upon and claims the benefit of priority from prior German Patent Application No. 10 2011 007 784.7, filed Apr. 20, 2011, the entire contents of all of which are incorporated herein by reference in their entirety.

The invention relates to a condenser, in particular a condenser which is cooled by cooling medium, according to the preamble of claim 1.

A condenser is used in heat engines and in refrigerating installations for the liquefaction of the exhaust steam or the vapor-like refrigerating medium. In the installations mentioned, this enables a closed circuit process. In a condenser of an air-conditioning system, the thermal energy absorbed during the cooling of an internal space is discharged to the environment again. Whilst in conventional air-cooled condensers the heat is discharged to the air, in condensers which are cooled with cooling medium the heat is introduced into an interposed water circuit. Condensers of the generic type are known from the prior art.

For example, WO 2004 04 2293 A1 discloses a condenser within an air-conditioning circuit. WO 2001 088 454 A1 further discloses a motor vehicle condenser arrangement and a heat exchanger system. Furthermore, various embodiments of an indirect condenser for motor vehicle applications based on a stacked disk arrangement are known from the prior art.

However, the solutions known from the prior art in most cases have a plurality of disadvantages. For instance, with the stacked disk arrangement, both flow paths generally have the same hydraulic diameter. However, either the cross-section of the cooling water side is thereby constructed to be excessively small, which results in high pressure drops at the water side, or the hydraulic diameters for the cooling medium side are too high for an optimum configuration.

An object of the invention is to provide a condenser of the type mentioned in the introduction, by means of which it is possible for cooling water which is available to be used for optimal heat transmission from refrigerating medium to cooling medium, without thereby producing excessively high pressure drops. Furthermore, the temperature progression present during the condensation is intended to be able to be configured in a more advantageous manner.

This object is achieved by a condenser having the features of claim 1. The dependent claims relate to advantageous embodiments.

The object is achieved according to the invention in that the ratio of the two hydraulic diameters ($D_{hCooling\ medium}$) to $D_{hRefrigerating\ medium}$) is greater than (>) 1.3. As a result of the ratio set out of the two hydraulic diameters relative to each other or as a result of specific advantageous geometry parameters, the heat transmission can be increased and at the same time the pressure drop at the cooling medium side can be reduced. The hydraulic diameter $D_h$ is a theoretical variable in order to carry out calculations on pipes or channels having a non-circular cross-section. With the term $$d_h = \frac{4A}{U} = 4r_{hy}$$

it is possible to calculate as with a round pipe.

It is the quotient resulting from four times the flow cross-section A and the periphery U wetted by the fluid (optionally inside and outside) of a measurement cross-section.

The Applicant has found that the ratio of the two hydraulic diameters ($D_{hCooling\ medium}$) to ($D_{hRefrigerating\ medium}$) is intended to be greater than 1.3. A further advantageous effect is achieved by a condenser when the ratio is between 1.3 and 4 and more preferably between 1.5 and 2.5. This has been found in tests carried out accordingly by the Applicant.

For example, the hydraulic diameter ($D_{hCooling\ medium}$) may be between 1.5 mm and 3 mm. The hydraulic diameter ($D_{hCooling\ medium}$) is defined, for example, by means of an intermediate element which may be constructed in the manner of a turbulence insert. In this instance, the intermediate element has a hydraulic diameter between 1.5 mm and 3 mm. The flat pipe and the intermediate element are connected to each other in a thermally conducting manner, for example, soldered. There is therefore produced a combination between the flat pipe and intermediate layer, through which the cooling medium is passed by the flat pipe in counter-current or co-current. This is an advantage with respect to known solutions which involve plate type construction and which have the same hydraulic diameters. With the solution according to the invention, it has been found that, as a result of an increase of the cross-section at the cooling medium side and a reduction of the cross-section at the refrigerating medium side, the heat transmission and pressure drop can be optimized.

A preferred embodiment for achieving the refrigerating-medium-side flow cross-section set out is, for example, a flat pipe having a plurality of flow channels. For example, the hydraulic diameter ($D_{hRefrigerating\ medium}$) may be between 0.2 mm and 1.8 mm, preferably between 0.4 mm and 1.3 mm. Preferably, the flow cross-section of the cooling-medium-side flow channels has a substantially rectangular cross-section shape, the width b of each flow channel preferably being at least slightly smaller than the height h thereof. For the refrigerating medium flow, extruded flat pipes are preferably used. These comprise, for example, a pipe covering and have inner webs in order to increase the strength and to increase the heat transmission surface-area. A preferred pipe has a greater height than width since, in this instance, owing to capillary effects, an additional advantage in terms of output can be achieved. The flow cross-section of each pipe is characterized in this instance by the hydraulic diameter.

Another preferred embodiment makes provision for both the cooling-medium-side and the refrigerating-medium-side flow paths to be able to have a plurality of diversions when viewed in the flow course. In particular as a result of the refrigerating-medium-side diversions, it is possible to construct a circuit and to compensate for the density change of the refrigerating medium during condensation and to optimize the driving temperature differences.

There may further be provision for the refrigerating-medium-side flow path to be connected in a degressive manner, in such a manner that the flow cross-section of the last refrigerating-medium-side flow path is at least slightly smaller than the refrigerating-medium-side flow path of the first flow path. The term "degressive" is intended in this instance to refer to the relationship between two variables, for example, when the hydraulic diameters and flow guides of cooling medium and refrigerating medium are adapted to the respective flow speeds or when one variable increases and the other also increases in each case. In the condenser itself, the refrigerating medium is only cooled to the condensation temperature thereof. Subsequently, the condensation of the refrigerating medium is carried out before a further sub-cooling of the refrigerating medium to a temperature below the condensation temperature. In this process, the specific volume of the refrigerating medium decreases considerably (that is to say, to 1/10-1/20 of the initial volume). In order to take into account this decrease in volume, the refrigerating medium flow is guided through the component in a plurality of flow paths which are arranged one behind the other and which have a flow cross-section surface-area which decreases from path to path (—> degressive circuit). This is achieved by the number of pipes which are connected in parallel in a path decreasing from path to path.

As already described, the refrigerating medium only has heat removed then is condensed in the component (the temperature remaining constant over a wide range here) and subsequently further cooled. In practice, the following requirements therefore remain for the guiding of the cooling medium flow:

- the cooling medium is intended to be introduced into the condenser in the region of the sub-cooling and then guided in counter-current;
- in the region of the condensation, owing to the constant temperature at the cooling medium side, it is irrelevant whether the flow is guided in counter-current or in co-current;
- the refrigerating medium is intended to be guided from the device in the region of the overheating in counter-current.

The driving temperature gradient in the heat exchanger/condenser is thereby optimized and a high output is thereby achieved. As already described, the refrigerating medium side has a degressive circuit in this instance, whilst the cooling medium side has almost no change in specific volume so that, with optimum circuitry, substantially uniform flow cross-sections are provided.

For example, the refrigerating medium used may preferably be R-1234yf and the cooling medium used preferably water/glysantin (depending on the degree of dilution with water, glysantin is frost-resistant up to below −40 degrees Celsius. In addition it protects against corrosion). With a GWP factor of only 4, R-1234yf is approximately 357 times more environmentally friendly than known common refrigerating media and is 97 per cent below the threshold value of 150 GWP. In comparison with $CO_2$ as a cooling medium, it operates in a more efficient manner, in particular at higher temperatures.

Another preferred embodiment makes provision for the cooling-medium-side flow paths and the refrigerating-medium-side flow paths to be able to be in counter-current at least in the first and in the last flow path, but preferably in all the flow paths.

An embodiment of the invention further provides for the optimization of the structural depth of a pipe/rib unit. Thus, for example, the depth T or t of a pipe/rib unit or each flat pipe or each intermediate layer may be between 10 mm and 100 mm, preferably between 16 mm and 35 mm, respectively.

The solution set out in this instance can advantageously be produced in a cost-effective manner and has a compact configuration.

Other advantages, features and details of the invention will be appreciated from the following description, in which embodiments of the invention are described with reference to the drawings. The features mentioned in the claims and the description may each be significant to the invention individually per se or in any combination.

Figure 1:
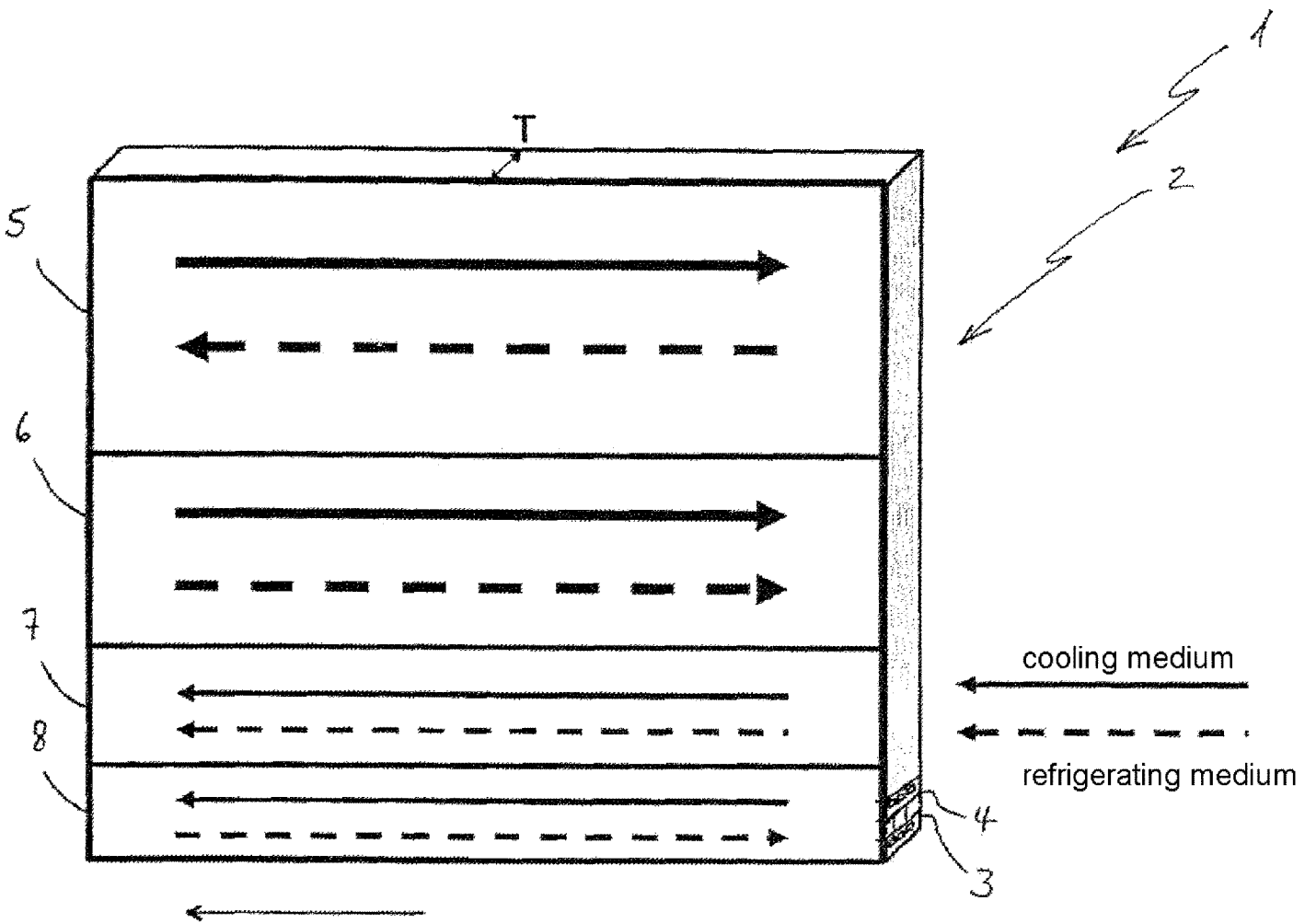
FIG. 1 is a schematic, perspective view of a first condenser according to the invention formed from a plurality of flat pipes.

FIG. 1 is a schematic, perspective view of a first condenser 1 according to the invention. The condenser 1 is constructed as a condenser 1 cooled with cooling medium and comprises inter alia a pipe/rib block 2 which in turn is formed by a plurality of flat pipes 3 with intermediate layers 4. Both the flat pipes 3 and the intermediate layers 4 which are connected to the flat pipes by means of a soldering operation are illustrated only schematically in the illustrations shown here. The flat pipes 3 or the intermediate layers 4 extend along the flow path SW.

In the embodiment shown in this instance, the pipe/rib block 2 has a structure which is formed by four pipe units 5, 6, 7, 8. Each pipe unit 5, 6, 7, 8 comprises a plurality of flat pipes 3 or intermediate layers 4. The number of flat pipes 3 and intermediate layers 4 and the hydraulic diameters and flow guides of cooling medium and refrigerating medium are adapted to the respective flow speeds. The number of flat pipes 3 and the number of intermediate layers 4 thus decrease continuously from the pipe unit 5 to the pipe unit 8.

In the embodiment shown in this instance, the flow paths SW of the refrigerating medium (broken line) and the cooling medium (solid line) are located in the pipe units 5 and 8 using a plurality of diversions in counter-current. The flow paths SW which extend adjacent to each other in the pipe units 5 and 8 consequently have flow directions (flow paths) which substantially extend in opposing directions. In this embodiment, two water-side flow paths are illustrated, the two refrigerating medium flow paths 5, 6 being connected to a first water-side flow path and the refrigerating medium flow paths 7, 8 being connected to a second water-side flow path.

Figure 2:
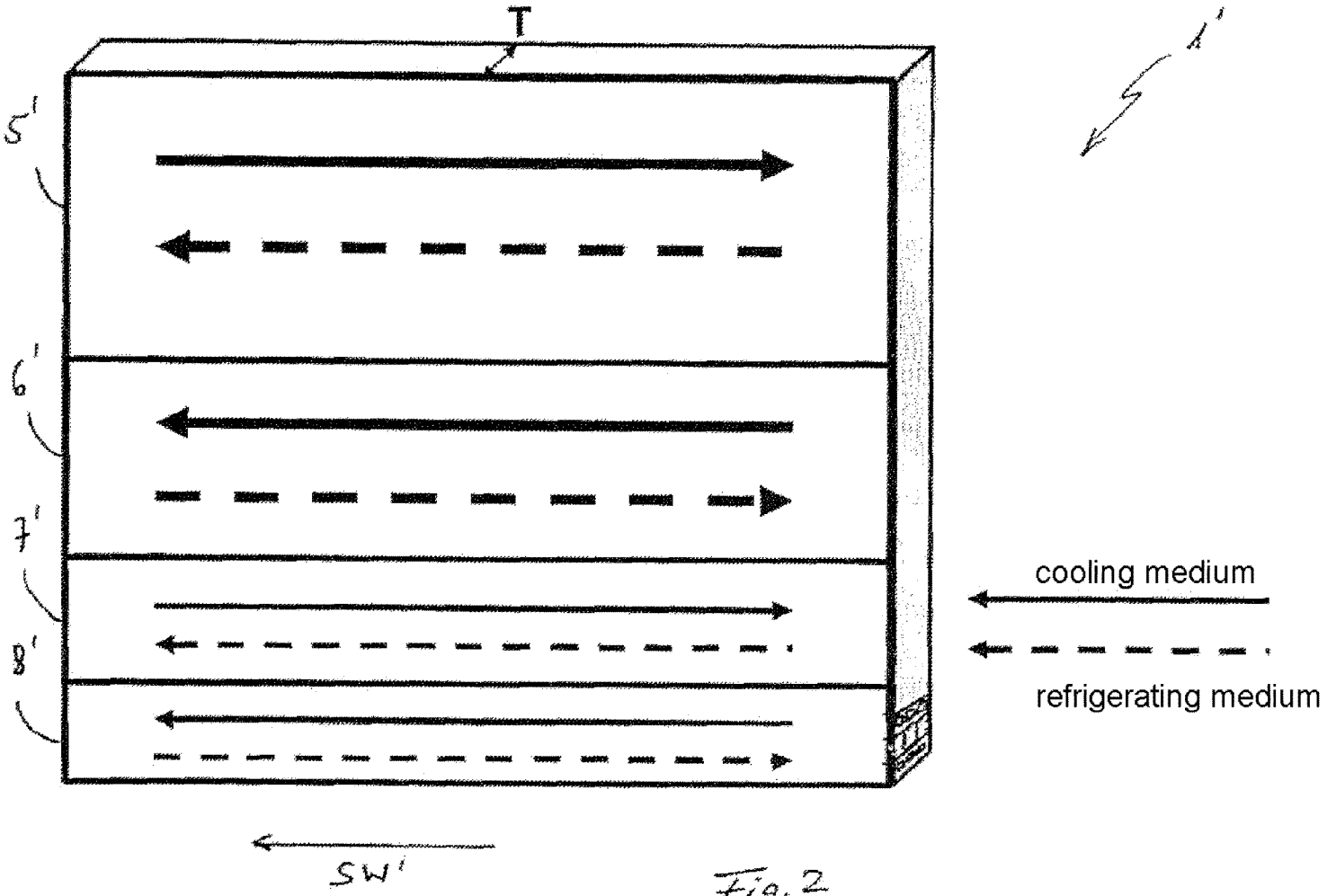
FIG. 2 is a schematic, perspective view of a second condenser according to the invention formed from a plurality of flat pipes.

FIG. 2 shows a second embodiment of a condenser 1'. The condenser 1' substantially corresponds to the condenser 1 according to FIG. 1 in terms of its structure.

The condenser 1' also has four pipe units 5', 6', 7', 8', the flow paths SW' of the refrigerating medium (broken line) and the cooling medium (solid line) in contrast to the condenser 1 shown in FIG. 1 being located in all four pipe units 5', 6', 7', 8' in counter-current. The flow paths SW' which extend in an adjacent manner in the pipe units 5', 6', 7', 8' consequently have flow directions which extend substantially in opposing directions.

Figure 3:
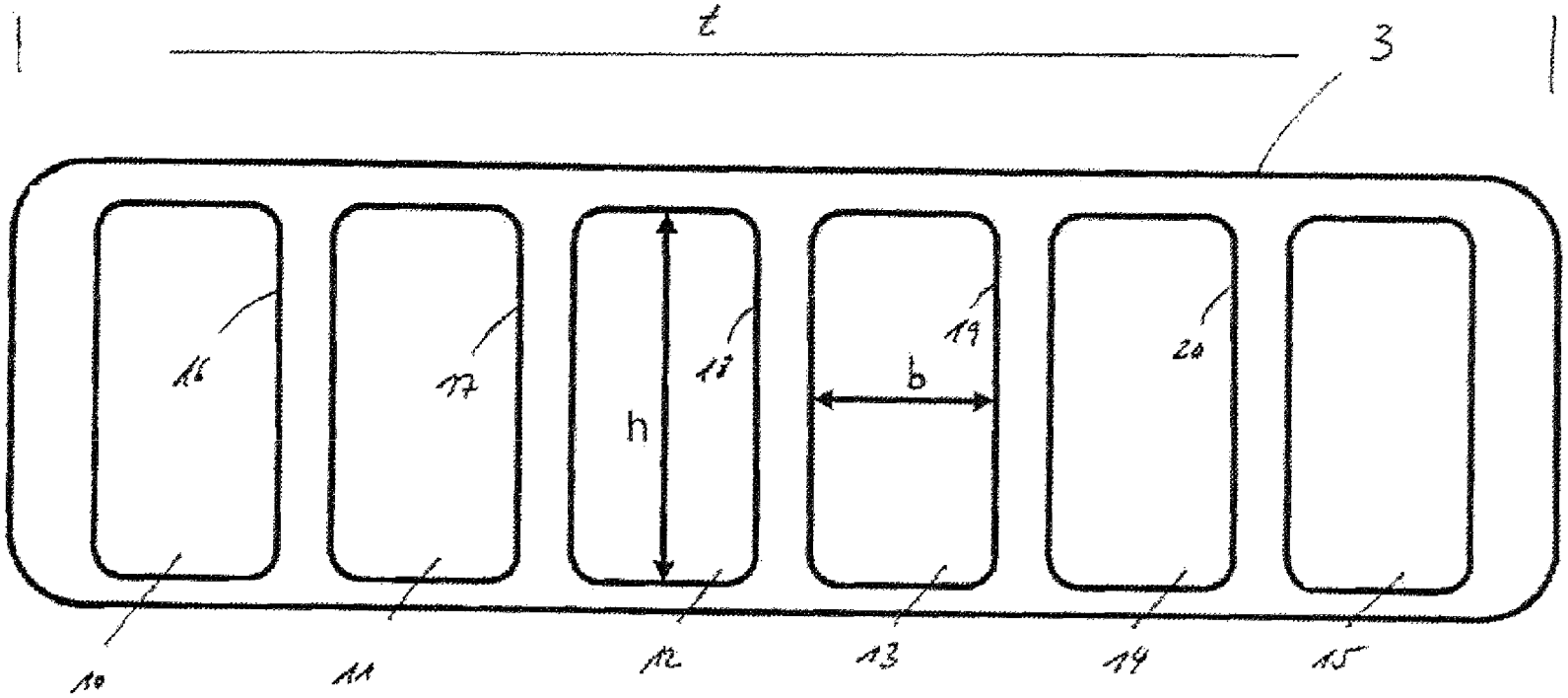
FIG. 3 is a schematic view of the end face of a flat pipe according to the invention.

FIG. 3 is a schematic view of the end face of a flat pipe 3. The flat pipe 3 has six flow channels 10, 11, 12, 13, 14, of the same flow cross-section or the same hydraulic diameter ($D_{hRefrigerating\ medium}$), which channels extend in the longitudinal direction of the pipe. The cooling-medium-side flow channels 10, 11, 12, 13, 14, 15 have a substantially rectangular cross-sectional shape, the width b of each flow channel preferably being at least slightly smaller than the height h thereof.

Webs 16, 17, 18, 19, 20 are formed between the flow channels 10, 11, 12, 13, 14, 15. In this instance, the webs 16, 17, 18, 19, 20 have a minimum thickness which is sufficient to ensure the stability of the flat pipe 3. The minimum thickness to be selected may, for example, be produced by the total depth t of the flat pipe 3 or by the selected hydraulic diameter ($D_{hRefrigerating\ medium}$) of the flow channels 10, 11, 12, 13, 14, 15.

Figure 4:
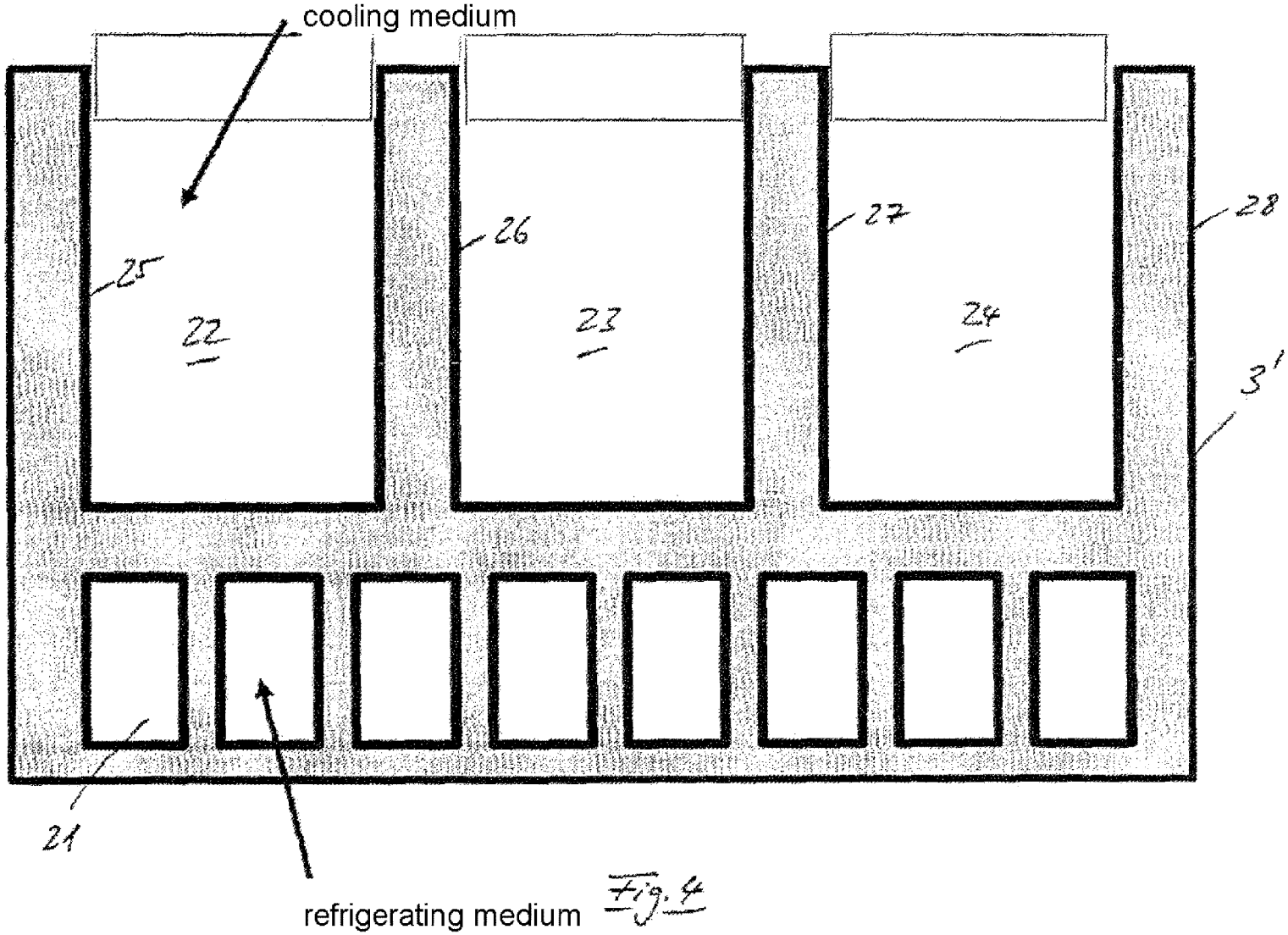
FIG. 4 is a schematic view of another embodiment of a flat pipe according to the invention for forming a pipe/rib block.

FIG. 4 shows another embodiment of a flat pipe 3'. The flat pipe 3' substantially has a plurality of flow channels 21 which are constructed in an identical manner and four webs 25, 26, 27, 28 which define the intermediate layer 22, 23, 24. The flat pipe 3' consequently comprises a combination of flat pipe/intermediate layer. For example, a single-piece production or construction may be provided. However, it would also be conceivable to construct the webs 25, 26, 27, 28 for forming the intermediate layers (intermediate elements) 22, 23, 24 as separate components which are connected to the flat pipe 3' in another operating step, for example, by means of a soldering operation.

The invention claimed is:

1. A condenser cooled by cooling medium, comprising at least one pipe/rib block having a plurality of pipe units, wherein each pipe unit comprises a plurality of flat pipes arranged in parallel to one another, wherein each flat pipe has a refrigerating-medium-side flow path characterized by a plurality of flow channels which extend beside each other in the transverse direction of the pipe, wherein each flat pipe has a cooling-medium-side flow path bounded by at least one intermediate element mechanically attached to the flat pipe in a thermally conducting manner, wherein (i) at least one refrigerating-medium-side flow path and (ii) at least one cooling-medium-side flow path bounded by the at least one intermediate element mechanically attached to the flat pipe of the at least one refrigerating-medium-side flow path are in counter-current with respect to one another, wherein between each pipe unit of the plurality of pipe units is arranged diversions for independently diverting the at least one refrigerating-medium-side flow path and the at least one cooling-medium-side flow path 180 degrees such that the at least one refrigerating-medium-side flow paths of at least one pair of adjacent pipe units flow in opposite directions and the at least one cooling-medium-side flow paths of at least one pair of adjacent pipe units flow in opposite directions, wherein the refrigerating-medium-side flow path is connected in a continuously degressive manner, in such a manner that a flow cross-section of a last refrigerating-medium-side flow path is at least slightly smaller than the refrigerating-medium-side flow path of a first flow path, wherein the plurality of flow channels define a refrigerating-medium-side hydraulic diameter ($D_{hRefrigerating\ medium}$), and wherein the at least one intermediate element defines a cooling-medium-side hydraulic diameter ($D_{hcooling\ medium}$), wherein a ratio of the two hydraulic diameters ($D_{hCooling\ medium}$) to ($D_{hRefrigerating\ medium}$) is greater than (>) 1.3, wherein the hydraulic diameters ($D_h$) of the cooling medium ($D_{hCooling\ medium}$) and refrigerating medium ($D_{hRefrigerating\ medium}$) are calculated using the equation:

$$d_h = \frac{4A}{U} = 4r_{hy}$$

wherein A is a cross-sectional area of flow, U is a wetted perimeter of a fluid flowing through the cross-sectional area, and $r_{hy}$ is the hydraulic radius of the cross-sectional area.

2. The condenser as claimed in claim 1, wherein the ratio of the two hydraulic diameters ($D_{hCooling\ medium}$) to ($D_{hRefrigerating\ medium}$) is between 1.3 and 4.

3. The condenser as claimed in claim 1, wherein the cooling-medium-side hydraulic diameter ($D_{hCooling\ medium}$) is between 1.5 mm and 3 mm.

4. The condenser as claimed in claim 1, wherein the refrigerating-medium-side hydraulic diameter ($D_{hRefrigerating\ medium}$) is between 0.2 mm and 1.8 mm.

5. The condenser as claimed in claim 1, wherein the intermediate element is constructed in the manner of a turbulence insert.

6. The condenser as claimed in claim 1, wherein the flat pipes have a plurality of identically constructed flow channels which are arranged beside each other and which are orientated in the same direction, wherein a width (b) of each flow channel is at least slightly smaller than a height (h) thereof.

7. The condenser as claimed in claim 1, wherein both the cooling-medium-side and the refrigerating-medium-side flow paths have a plurality of diversions when viewed in a flow course.

8. The condenser as claimed in claim 1, wherein at least in the first and in the last flow path of the cooling-medium-side flow paths and the refrigerating-medium-side flow paths are in counter-current.

9. The condenser as claimed in claim 1, wherein a depth (t) of a pipe/rib unit or a flat pipe is between 10 mm and 100 mm.

10. The condenser as claimed in claim 2, wherein the ratio of the two hydraulic diameters ($D_{hCooling\ medium}$) to ($D_{hRefrigerating\ medium}$) is between 1.5 and 2.5.

11. The condenser as claimed in claim 1, wherein the refrigerating-medium-side hydraulic diameter ($D_{hRefrigerating\ medium}$) is between 0.4 mm and 1.3 mm.

12. The condenser as claimed in claim 8, wherein the cooling-medium-side flow paths and the refrigerating-medium-side flow paths are in counter-current in all flow paths.

13. The condenser as claimed in claim 9, wherein a depth (t) of a pipe/rib unit or a flat pipe is between 16 mm and 35 mm.

* * * * *